United States Patent [19]

Zeigler

[11] Patent Number: 4,747,239

[45] Date of Patent: May 31, 1988

[54] BRACKETS FOR CONNECTING ADJACENT EXHIBIT FRAMES TOGETHER

[76] Inventor: Theodore R. Zeigler, 9923 Indian Queen Point Rd., Oxon Hill, Md. 20022

[21] Appl. No.: 552,719

[22] Filed: Nov. 17, 1983

[51] Int. Cl.[3] ..... E04H 12/18

[52] U.S. Cl. ..... 52/109; 52/581; 52/646

[58] Field of Search ..... 52/646, 109, 582, 677, 52/581, 81; 135/110, 103, 111

[56] References Cited

U.S. PATENT DOCUMENTS

| | | | |
|---|---|---|---|
| 563,375 | 7/1896 | Heintz | 135/110 |
| 815,409 | 3/1906 | Cummings | 52/687 |
| 904,978 | 11/1908 | Miles | 52/687 |
| 3,131,705 | 5/1964 | Marino | 135/103 |
| 3,354,596 | 11/1967 | Schafer | 52/646 |

FOREIGN PATENT DOCUMENTS

| | | | |
|---|---|---|---|
| 304368 | 6/1933 | Italy | 52/677 |

*Primary Examiner*—John E. Murtagh
*Attorney, Agent, or Firm*—John P. Snyder

[57] ABSTRACT

A pair of self-supporting exhibit frames formed of a plurality of pairs of crossed rods are constructed so as to be moved between a collapsed position at which the rods are disposed in a compact bundle of side-by-side rods and an erected position at which each exhibit frame includes a lateral upstanding side defined by at least two crossed rods disposed in a generally X-shaped pattern, the exhibit frames being positioned with their lateral upstanding sides immediately adjacent each other and with the X-shaped rods aligned, and at least one bracket spanning the lateral upstanding sides, the bracket including at least two slots and preferably four slots disposed with one pair of slots along each of two side edges of the bracket, and the slots being sized to snugly frictionally grippingly engage the X-shaped rod to thereby maintain the exhibit frames locked together in adjacent upstanding relationship.

10 Claims, 1 Drawing Sheet

BRACKETS FOR CONNECTING ADJACENT EXHIBIT FRAMES TOGETHER

Exhibit frames of the type to which the present invention are directed are generally constructed in the manner disclosed in copending application Ser. Nos. 403,363 and 409,435 filed on July 30, 1982 and Aug. 19, 1982, now U.S. Pat. Nos. 4,512,097 and 4,522,008, respectfully, in the name of Theodore R. Zeigler, and the contents of the latter application are herewith incorporated by reference. The most typically an exhibit frame of the type herein under consideration includes a plurality of pairs of rods pivotally connected between the ends thereof and also pivoted to inner and outer hubs or apical points in such a fashion that the exhibit frame can be moved between a collapsed position at which the rods are positioned in side-by-side relationship to form a compact bundle and an erected position at which the exhibit frame is self-locking and defines an upstanding frame to which graphics may be secured in a conventional manner.

A problem occurs when two exhibit frames are placed in side-by-side generally coplanar relationship, and this problem is acutely related to the graphics carried by the exhibit frames, whether as panels, webs or simply a single sheet of graphics overlying the entire exhibit frame. If the graphics of adjacent frames have a continuity of design, artwork, symmetry or the like, it is necessary for the exhibit frames so positioned adjacent each other or in side-by-side relationship to maintain this relationship absent inadvertent or accidental movement or spacing therebetween which would otherwise destroy the symmetry of the graphics on the adjacent exhibit frames. For example, if an exhibit frame had four panels running across the top numbered "1", "2", "3" and "4", and the next exhibit frame thereto had a like four panels continuing the numbering "5", "6", etc., any spacing between panel "4" of the first exhibit frame and panel "5" of the second exhibit frame would be highly undesirable and should the spacing become excessive by the exhibit frames being accidentally or inadvertently moved away from each other, such would be progressively further undesirable as the spacing increased. Quite simply in order to maintain the integrity of an exhibit it is necessary to maintain the exhibit frames of similar integrity by precluding relative shifting therebetween and it is to the latter problem that the present invention is directed.

In keeping with the present invention one or more brackets are utilized for releasably securing lateral sides of adjacent exhibit frames to each other by releasably interlocking between crossed rods of the lateral sides of adjacent exhibit frames. The crossed rods of the lateral sides or ends of the exhibit frames are generally disposed in an X-shaped pattern when the exhibit frames are in their erected position, and the exhibit frames are positioned adjacent each other with these X-patterned rods aligned. When so aligned the brackets of this invention are positioned in spanning relationship between the adjacent pairs of the X-shaped rods and when appropriately interlocked to the rods movement between adjacent exhibit frames is virtually precluded, thus assuring the integrity and continuity of graphics placed upon such adjacent exhibit frames.

The brackets of the present invention are preferably plates of plastic material having opposite end edges and opposite side edges, and the means for locking the plates to the rods are pairs of slots along each of the side edges which snugly frictionally grippingly engage the associated rods of the X-shaped or patterned rods of the adjacent exhibit frames thus assuring that the exhibit frames cannot be moved away from each other but permitting rapid connection and disconnection of the brackets relative thereto.

IN THE DRAWING

Figure 1:
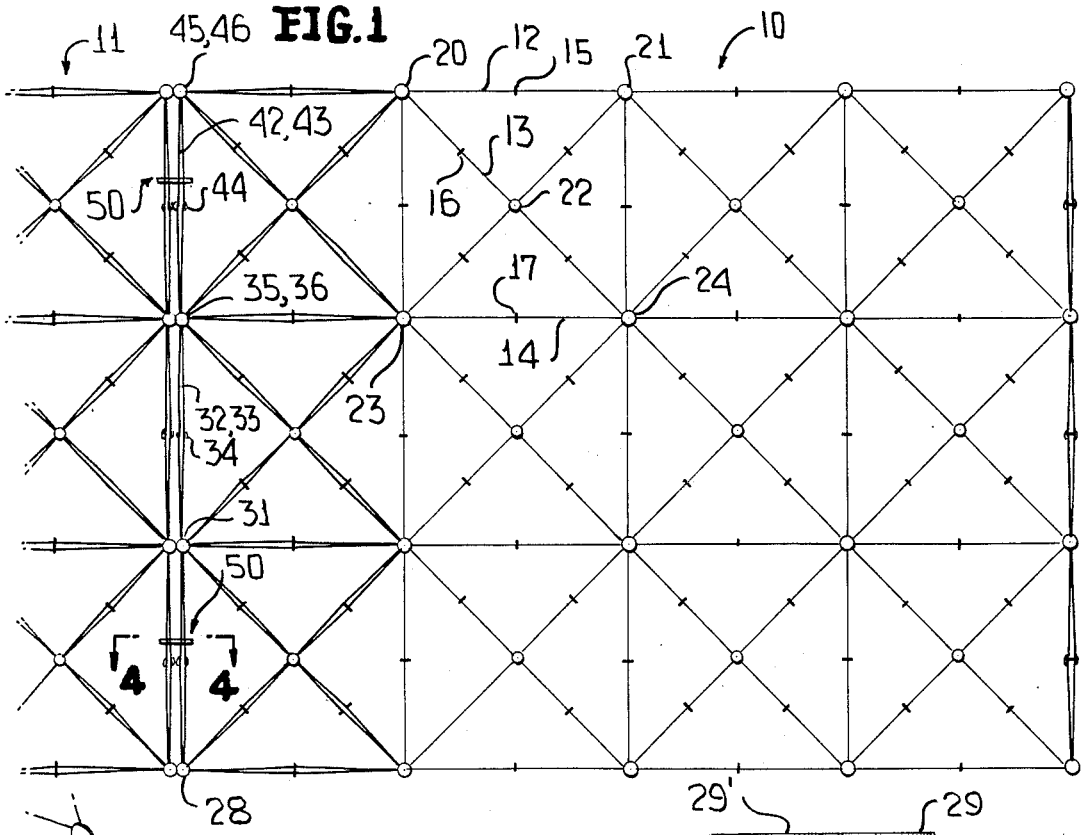
FIG. 1 is a front elevational view, partially fragmentary and partially schematic, of a pair of exhibit frames in erected upstanding relationship with lateral sides thereof immediately adjacent each other and secured to each other by a pair of brackets.

A pair of self-supporting structures or exhibit frames are illustrated in FIG. 1 of the drawing, and are generally designated by the reference numerals 10 and 11. The exhibit frames 10 and 11 are identical and the details thereof are further disclosed in the earlier noted application but for the purposes of the present disclosure it is sufficient to note that the exhibit frames 10, 11 are generally identical to each other insofar as each can be moved between a collapsed position at which the various rods 12, 13, 14, etc., are in generally side-by-side relationship to the erected or upstanding position in FIG. 1. The various rods 12, 13, 14 are actually disposed in pairs interconnected by pivots 15, 16, 17, respectively, for example, and opposite ends of the pivotally interconnected pairs of rods 12, 13, 14, etc. are also pivotally connected to a plurality of inner and outer hubs or apical points 20 through 24, for example.

Insofar as the present invention is concerned it need but be noted that the exhibit frame 10 includes a lateral side or edge defined by a first pair of crossed rods 25, 26 pivotally connected to each other by a pivot pin 27 and pivotally connected at lower and upper ends, respectively, to hubs 28, 29 and 30, 31, respectively.

Figure 3:
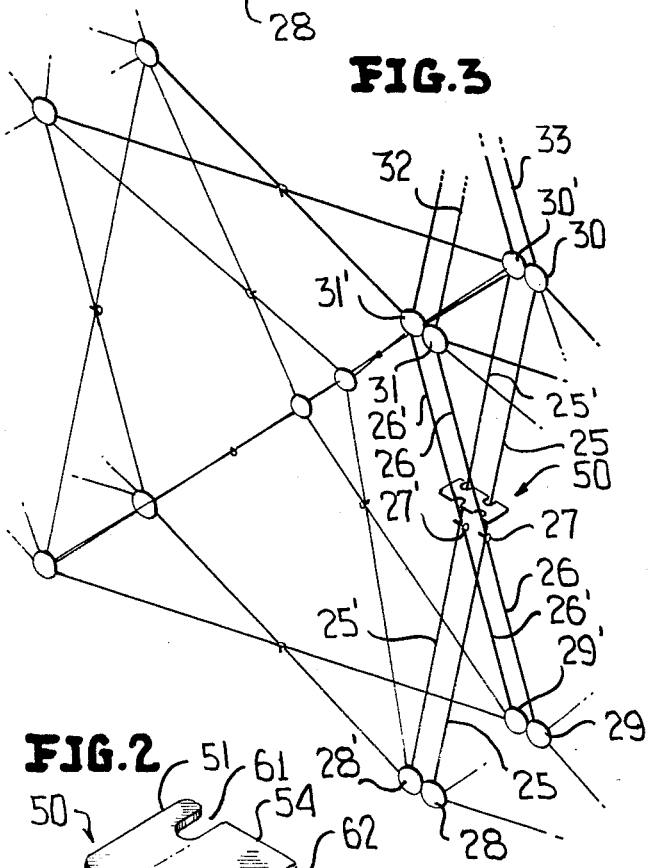
FIG. 3 is a schematic perspective view of the two lowermost adjacent lateral, side or end edges of the two exhibit frames of FIG. 1 and schematically illustrates the manner in which one of the brackets is positioned between and in spanning relationship to a pair of X-shaped, pivotally interconnected rods.

A like pair of crossed rods 32, 33 (FIGS. 1 and 3) are pivotally connected together by a pivot pin 34 with lower ends of the rods 32, 33 being connected to the hubs 31, 30, (FIG. 3). Upper ends of the rods 32, 33 are connected to hubs corresponding to the hubs 31, 30, and these have been collectively numbered 35, 36 in FIG. 1. Thus the crossed rods 32, 33 and pivot pin 34 are of a mirror construction of that of the crossed rods 25, 26 and the pivot pin 27.

In a like fashion an uppermost pair of rods 42, 43 are interconnected by a pivot pin 44 and are similarly pivotally connected to the hubs 35, 36 and to a pair of uppermost hubs collectively identified by the reference characters 45, 46. In this fashion the left lateral or end side, as used in FIG. 1, of the exhibit frame 10 is defined by three pairs of pivotally interconnected crossed rods 25,

26; 32, 33 and 42, 43 each of which define a generally X-shaped pattern, as is most evident in FIG. 3.

The exhibit frame 11 is, as was heretofore noted, constructed identically to the exhibit frame 10 and thus, the lateral edge thereof most adjacent that defined by the pivotally interconnected and crossed rods 25, 26; 32, 33; and 42, 43 has identical there primed reference numerals applied thereto, including the associaed hubs and pivot pins. For example, in FIG. 3, rods 25', 26' are pivotally interconnected by a pivot pin 27' and are also pivotally connected to the hubs 28' through 31'. The pivot pins 27, 27' are aligned as are the X-shaped or disposed rods 25, 26 and 25', 26', as is most evident from FIGS. 3 and 4 of the drawing.

The remaining rods, pins and hubs defining the lateral side or edge of the exhibit frame 11 have similarly primed in FIGS. 1 and 3, and it need simply be noted that the pivot pins 34, 34' and 44, 44' are respectively aligned as are the crossed rods 32, 33 and 32', 33'; and the crossed rods 42, 43 and 42', 43'.

Figure 2:
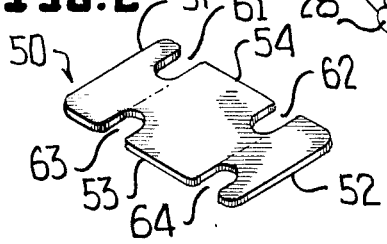
FIG. 2 is a perspective view of one of the brackets of FIG. 1 and illustrates the generally plate-like configuration thereof and a pair of slots formed in each of two opposite sides.
Figure 4:
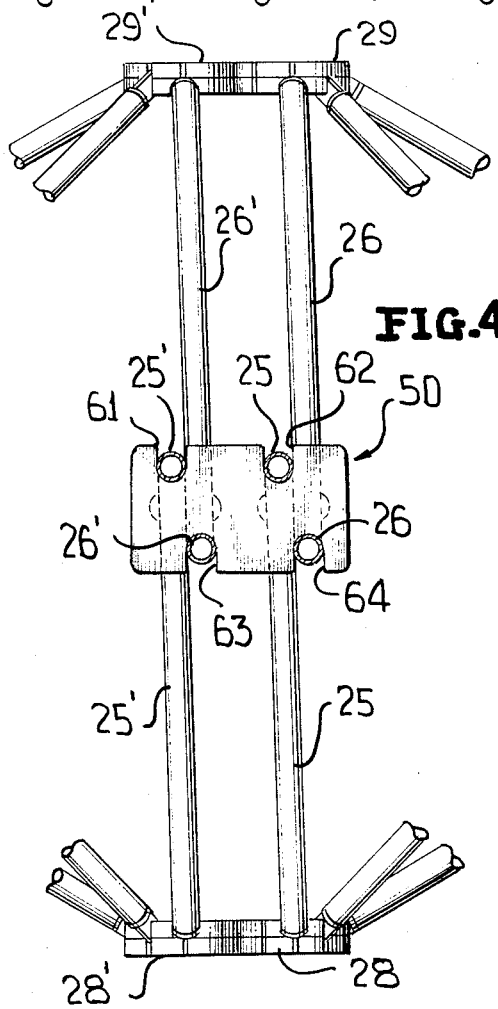
FIG. 4 is an enlarged sectional view taken generally along 4—4 of FIG. 1 and illustrates in clear detail the manner in which one of the brackets or plates is in releasable interlocked relationship to the X-shaped pairs of rods of adjacent exhibit frames.

With the crossed rods 25, 26; 25', 26', etc., thus positioned adjacent each other and in alignment, brackets constructed in accordance with this invention may be utilized for positively though releasably connecting the frames 10, 11 to each other through the various pairs of adjacent and aligned crossed rods, as will be most evident from FIGS. 2 through 4 of the drawings, in which one of the brackets is illustrated and is generally designated by the reference numeral 50.

The bracket 50 of FIGS. 2 through 4 of the drawing is a generally plate-like flat element formed of plastic material having opposite generally parallel end edges 51, 52 and opposite generally parallel side edges 53, 54 imparting a generally rectangular configuration to the overall bracket or plate 50. A plurality of identical means 61 through 64 are formed in the plate 50 such that when the plate or bracket 50 spans the adjacent pairs of rods (25, 26 and 25', 26' for example), the means 61 through 64 are operative for releasably frictionally grippingly embracing or clamping upon and against the associated rods, as for example, the rods 25, 26 and 25', 26' (FIG. 4) which are respectively gripped by the means 62, 64 and 61, 63, respectively. The means 61 through 64 are simply outwardly opening geneally U-shaped slots or openings and they are sized so as to snugly grip the exterior surfaces of the rods 25, 26, 25', 26', etc. Thus the plate 50 (FIGS. 3 and 4) is interlocked in spanning relationship between the pairs of rods 25, 26 and 25', 26', and any forces tending to separate the exhibit frames 10, 11, laterally or left-to-right or horizontally in FIG. 1, are offset by the bracket 50 and, of course, any other identical brackets that might be similarly interconnected in spanning relationship between the rods 32, 33 and 32', 33' and/or the rods 42, 43 and 42', 43', as is indicated by an uppermost bracket 50 in FIG. 1 which is, of course, identical to the bracket 50 of FIG. 4. There is no bracket shown in lateral spanning relationship to the rods 32, 33 and 32', 33', but another bracket may be likewise positioned therebetween if it is desired to further releasably secure the exhibit frames 10, 11 to each other.

The brackets or plates 50 are readily inserted in spanning relationship between the respective rods and removed therefrom by simply moving the plate 50, for example, upwardly in FIGS. 3 and 4 to release the same since the upper portions of the rods 25, 26, 25' and 26' diverge in a direction toward the hubs 30, 31, 30' and 31'. Thus a position is reached by the bracket 50 above that shown in FIGS. 3 and 4 at which the same can be readily withdrawn and, of course, conversely, the plate 50 can be readily interlocked by descending the same downwardly from a position adjacent to hubs 30, 31, 30', 31' toward the pivot pins 27, 27' until the full interlocked relationship of FIGS. 3 and 4 is achieved. At this position it should be noted that the natural converging relationship of the rods 25, 25', 26, 26' prevents the bracket 50 from moving further downwardly toward the pivot pins 27, 27'. Thus the bracket 50, when interlocked in the position shown, is maintained in such interlocked relationship by the design convergence of the rods 25, 26, 25' and 26', and, of course, the spacing between the slots 61, 62 and 63, 64 (FIG. 4). In this fashion the plate 50 cannot be inadvertently removed simply by gravity but must instead be manually gripped and moved upwardly for release thus assuring that once the exhibit frames 10, 11 are securely interlocked to each other by the bracket 50 they cannot be inadvertently moved away from each other, hence precluding graphics positioned thereupon from being other than maintained in the perfect symmetry of position and design intended.

I claim:

1. The combination of a pair of collapsible and expandable structures and a bracket for releasably securing the pair of structures together comprising a plurality of pairs of crossed rods defining each of said pair of structures, means for interconnecting said plurality of pairs of crossed rods of each structure for effecting movement thereof between a collapsed position at which said rods are disposed in a compact bundle of side-by-side rods and an erected expanded position a which each structure includes a lateral upstanding side defined by at least two crossed rods disposed in a generally X-shaped pattern, said structures being positioned with their lateral upstanding sides immediately adjacent each other, said bracket spanning said lateral upstanding sides, said bracket including first and second means for slidingly engaging, releasably securing and slidingly disengaging said bracket to one rod of each of said two crossed rods of each lateral side, respectively, whereby said bracket can be moved toward and away from the interconnecting means to respectively engage and disengage the bracket relative to the rods.

2. The combination as defined in claim 1 wherein said first and second means is each a slot contoured to snugly matingly engage its associated rod.

3. The combination as defined in claim 1 wherein said bracket is a generally plate-like body defined by a periphery, said first and second means is each a slot contoured to snugly matingly engage its associated rod, and said slots open outwardly relative to said periphery.

4. The combination as defined in claim 1 wherein said bracket is a generally plate-like body defined by a periphery, said first and second means is each a slot contoured to snugly matingly engage its associated rod, and said slots open outwardly relative to said periphery and in opposite directions relative thereto.

5. The combination as defined in claim 1 wherein said bracket is a generally plate-like body defined by a periphery, said first and second means is a pair of slots contoured to snugly matingly engage its associated pair of rods, an said slots open outwardly relative to said periphery.

6. The combination as defined in claim 1 wherein said bracket is a generally plate-like body defined by a periphery, said first and second means is a pair of slots contoured to snugly matingly engage its associated pair of rods, and said slots open outwardly relative to said periphery with one pair of slots opening in one direction and another pair of slots opening in an opposite direction.

7. The combination of a pair of portable collapsible and expandable exhibits and a bracket for releasably securing the pair of exhibits together comprising a plurality of pairs of crossed rods defining each of said pair of exhibits, means for interconnecting a plurality of pairs of crossed rods of each exhibit for effecting movement thereof between a collapsed position at which said rods are disposed in a compact bundle of side-by-side rods and an erected expanded position at which each exhibit includes a lateral upstanding side defined by at least two crossed rods disposed in a generally X-shaped pattern, said exhibits being positioned with their lateral upstanding sides immediately adjacent each other, said bracket spanning said lateral upstanding sides, said bracket including first and second means for slidingly engaging, releasably securing and slidingly disengaging said bracket to one rod of each of said two crossed rods of each lateral side, respectively, whereby said bracket can be moved toward and away from the interconnecting means to respectively engage and disengage the bracket relative to the rods.

8. The combination as defined in claim 7 wherein said pair of exhibits are disposed in a generally common plane.

9. The combination as defined in claim 7 wherein said first and second means of said bracket are secured to one rod of each of said two crossed rods of each lateral side.

10. The combination as defined in claim 9 wherein said pair of exhibits are disposed in a generally common plane.

* * * * *